United States Patent [19]

Gegauf

[11] 4,096,812

[45] Jun. 27, 1978

[54] CLUTCHING DEVICE FOR SEWING MACHINES

[75] Inventor: Fritz Gegauf, Steckborn, Switzerland

[73] Assignee: Fritz Gegauf Aktiengesellschaft, Bernina-Nähmaschinenfabrik, Switzerland

[21] Appl. No.: 533,211

[22] Filed: Dec. 16, 1974

[30] Foreign Application Priority Data

Jan. 10, 1974 Switzerland ..... 273/74

[51] Int. Cl.[2] ..... D05B 59/00

[52] U.S. Cl. ..... 112/220; 242/22; 112/279

[58] Field of Search ..... 112/221, 220, 218 R, 112/279; 242/18, 22

[56] References Cited

U.S. PATENT DOCUMENTS 3,670,974 6/1972 Ueltschi ..... 112/218 A

FOREIGN PATENT DOCUMENTS 1,084,523 7/1954 France ..... 112/218 A

*Primary Examiner*—H. Hampton Hunter
*Attorney, Agent, or Firm*—McGlew and Tuttle

[57] ABSTRACT

The device is incorporated in a sewing machine having an arm enclosing and rotatably mounting an arm shaft connected to the sewing mechanism, a drive wheel rotatably mounted on the arm shaft and driven in any suitable manner, and a thread winder including a wheel selectively engageable with the drive wheel. A clutch ring surrounds the arm shaft and is pivotal on a pin extending diametrically of the arm shaft, the clutch ring having a trapezoidal engaging cam engageable in trapezoidal recesses in the drive wheel. A flat spring biases the clutch ring normally to couple the drive wheel to the arm shaft. When the thread winder is moved into a position adjacent a fixed stop, a release stirrup engages the clutch ring and pivots it to a position disconnecting the drive wheel from the arm shaft. Another spring biases the release stirrup away from the clutch ring. The increasing diameter of the thread wound on a bobbin on the thread winder, in cooperation with the fixed stop, gradually moves the thread winder away from the fixed stop and, after a predetermined such movement, the thread winder is effectively uncoupled from the drive wheel and may be swung to a position wherein the stirrup member releases the clutch ring for spring biased reengagement with the drive wheel to automatically recouple the drive wheel to the arm shaft.

4 Claims, 4 Drawing Figures

CLUTCHING DEVICE FOR SEWING MACHINES

FIELD AND BACKGROUND OF THE INVENTION

This invention relates to a clutching device for sewing machines adapted to disengage the sewing mechanism of the machine to permit the winding of the lower thread.

Usually, the drive wheel of a sewing machine is coupled to a flanged sleeve mounted on the arm shaft so that, by means of a releasing screw adapted to be manually screwed into the flanged sleeve, axial pressure is exerted on the hub of the drive wheel through an intermediate disk. The necessary friction is thereby produced, between the hub of the drive wheel and the flange of the flanged sleeve, for driving the sewing mechanism of the machine.

This frictional power transmission has the great disadvantage that, while sewing a thick material, a very strong tightening of the releasing drive-wheel screw is necessary to insure the transmission of the needed power. The force to be exerted while tightening and loosing the release screw is correspondingly great so that many seamstresses and, particularly female apprentices, find it considerably difficult.

Releasing devices for the drive wheel of a sewing machine are already known in which a locking mechanism effective in the running direction of the machine is mounted between the drive wheel and the main shaft of the sewing machine and adapted to be made ineffective, in some manner, to disengage the sewing mechanism from the drive wheel. Such locking mechanisms are very disadvantageous in that the machine cannot be turned back by the drive wheel. Thus, it is not possible to lift the needle from the already pierced material without forming a stitch at the same time. Many arrangements have already been provided to remedy this drawback. However, up to date, they have not found use in practice because they are too complicated and, consequently, too expensive.

In addition, all hitherto known devices for disengaging the sewing mechanism of a machine from the drive wheel have the disadvantage that some additional manipulation is necessary for engaging or disengaging the coupling, whereby the operation of the sewing machine is rendered more difficult.

SUMMARY OF THE INVENTION

The invention is directed to a clutching device, for disengaging the sewing mechanism of the machine from the drive wheel, which is automatically engaged or disengaged during the operation of the winder so that no additional manipulation is necessary for the actuation of the coupling.

In accordance with the invention, there is provided a clutch member adapted to cooperate with the winder, by means of which the sewing mechanism of the machine is automatically disengaged from the drive wheel as soon as the winder is engaged therewith, and the drive connection between the drive wheel and the sewing mechanism of the machine is automatically reestablished as soon as the winder is disengaged from the drive wheel.

An object of the invention is to provide an improved clutching device for sewing machines.

Another object of the invention is to provide such a clutching device which is operable automatically to uncouple the sewing mechanism from the drive wheel responsive to engagement of the thread winder with the drive wheel and automatically to recouple the sewing mechanism to the drive wheel responsive to disengagement of the thread winder from the drive wheel.

A further object of the invention is to provide such a clutching device which is simple in construction, inexpensive in cost, and efficient in operation.

For an understanding of the principles of the invention, reference is made to the following description of a typical embodiment thereof as illustrated in the accompanying drawings.

DESCRIPTION OF THE PREFERRED EMBODIMENT

Figure 1:
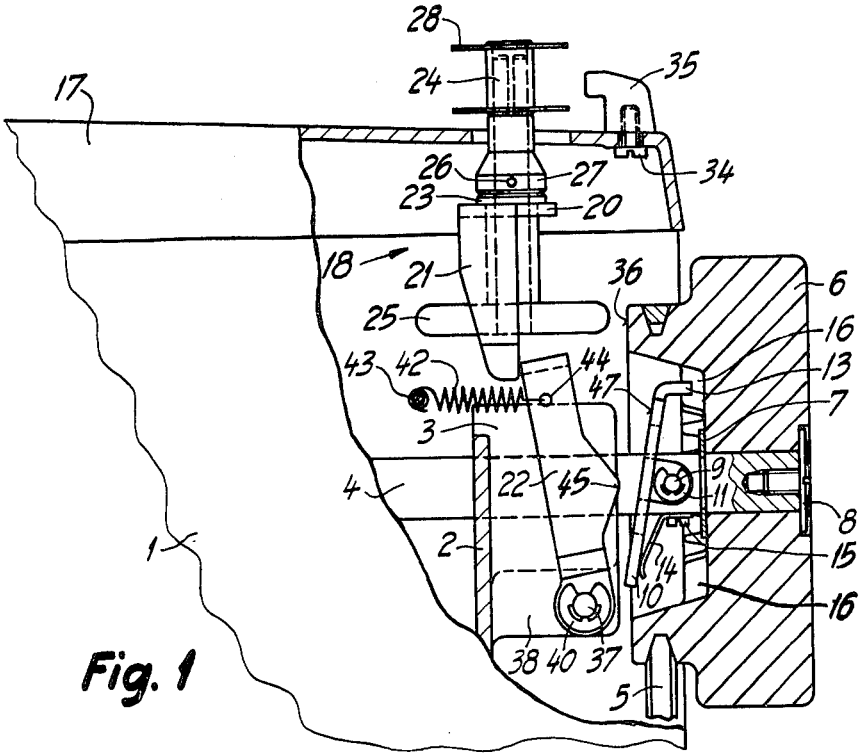
FIG. 1 is a partial side elevational view of the arm of a sewing machine, the lateral wall of the housing being partly broken away and the winder being shown in its disengaged position.

Referring to the drawings, the arm housing 1 of a sewing machine comprises a transverse back wall 2 supporting the rear bearing 3 of an arm shaft 4. A drive wheel 6, driven by suitable means such as a power source (not shown) through a drive element 5, is mounted for free rotation on arm shaft 4. Drive wheel 6 is secured against axial displacement on arm shaft 4 by a locking plate 7 and a cap screw 8 screwed axially into the end portion of the arm shaft 4. A clutch ring 10, surrounding arm shaft 4, is pivotally mounted on a pin 9 extending diametrically through arm shaft 4 and axially secured by two retaining washers 11 and 12. Clutch ring 10 is biased by a flat spring 14 which is secured to arm shaft 4 by means of a screw 15, and is provided with a trapezoidal engaging cam 13 which, due to the action of spring 14, engages in one of the trapezoidal engaging grooves 16 provided in and circularly arranged on drive wheel 6. As soon as drive wheel 6 is put in motion by the power source through drive element 5, the rotation is transmitted through the respective engaging groove 16, engaging cam 13 of clutch ring 10 and pin 9 to arm shaft 4, whereby the sewing mechanism of the machine (not shown) is put in operation.

Figure 4:
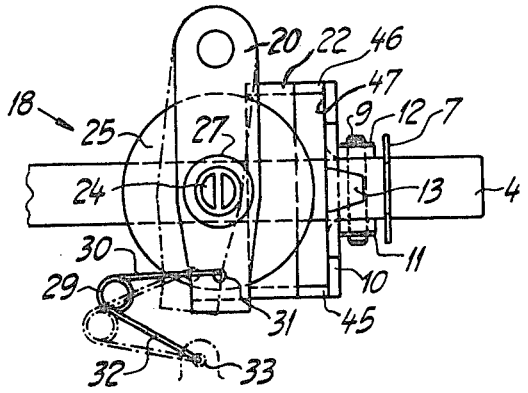
FIG. 4 is a top plan view of the winder and the release mechanism, the drive wheel being dismounted and the housing of the machine omitted.

A winder, generally designated 18, is supported in a well known manner in the arm cover 17. A winder arm 20 is mounted by means of an attachment screw 19 for horizontal pivoting on arm cover 17 and comprises a downwardly bent extension 21, cooperating with a release stirrup 22 to actuate clutch ring 10, and supports a collar sleeve 23 in which a winder shaft 24 is mounted for free rotation. Winder shaft 24 is secured in collar sleeve 23 against axial displacement by a winder wheel 25 press-fitted on winder shaft 24 and by a stop sleeve 27, for a thread bobbin 28, which is secured to winder shaft 24 by a pin 26. The upper end portion of winder shaft 24 projecting from arm cover 17 is slotted and intended, in a well known manner, to receive thread bobbin 28. A catch sping 29, designed as a torsion spring, engages, with one of its legs 30, into a bore 31 of winder arm 20 and, with its other leg 32, into a bore 33 of arm cover 17. Catch spring 29 retains the winder 18 in its disengaged, rest position, as shown in FIG. 4 in dash-dotted lines.

Figure 2:
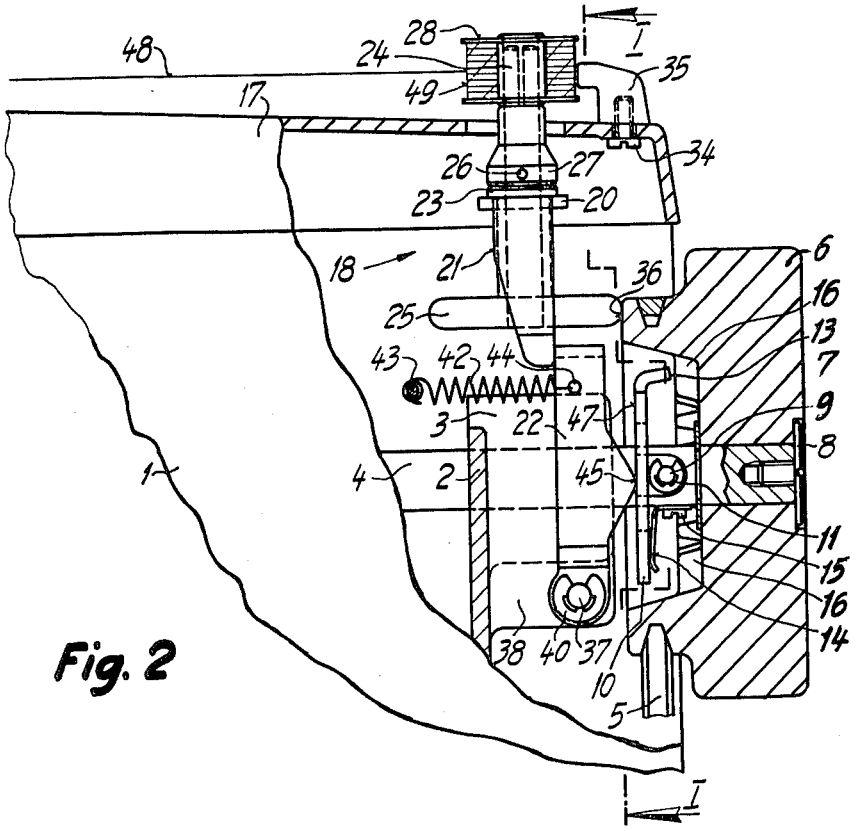
FIG. 2 is a view similar to FIG. 1, with the winder being shown in its engaged position.
Figure 3:
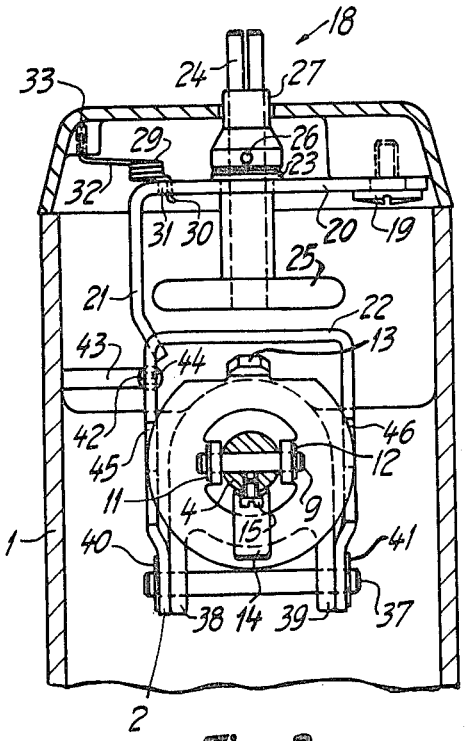
FIG. 3 is a cross-sectional view taken along the line I—I of FIG. 2.

To start the winding operation after putting a thread bobbin in place on the slotted end of winder shaft 24, winder 18 is pivoted about the axis of attachment screw 19 in the direction of a stop dog 35 which is secured on arm cover 17 by means of a screw 34. Thereby, catch spring 29 changes its direction of action and retains winder 18 in its engaged position in which winder sheel 25 applies against a friction ring 36 of drive wheel 6 and is driven, along with winder 24, due to the rotation of drive wheel 6 (FIG. 2).

To put the sewing mechanism of the machine out of action during the winding operation, the coupling between drive wheel 6 and arm shaft 4 must be disconnected. For this purpose, release stirrup 22 is pivotally mounted between extension 21 of winder arm 20 and clutch ring 10. Release stirrup 22 is mounted on a pin 37 which extends through two ears 38 and 39 of rear bearing 3 of the arm shaft and is secured in its position by locking washers 40 and 41. A helical spring 42 is suspended, by its one end, from a fixed bolt 43 and, by its other end, from a bore 44 of release stirrup 22 and pulls release stirrup 22 against extension 21 of winder arm 20.

Upon engaging of the winder 18 in the just described manner, release stirrup 22 is pivoted, by extension 21 of winder arm 20 and against the action of helical spring 42, about its axis 37 in the direction of drive wheel 6. Thereby, two engaging cams 45 and 46 of release stirrup 22 come into operative engagement with the annular surface 47 of clutch ring 10 and swing clutch ring 20 into its vertical position, shown in FIGS. 2 and 4. The result is that engaging cam 13 is disengaged from the respective engaging groove 16 of drive wheel 6, the coupling is disconnected, and drive wheel 6 is freely rotatable on arm shaft 4. In this position of winder 18 and clutch ring 10, the winding of lower thread 48 on thread bobbin 28 takes place. Catch spring 29 is selected sufficiently strong so as to be able to overcome both the opposed actions of helical spring 42 and flat spring 14 and the counteracting tensile force produced during the winding of lower thread 48.

As soon as the thread on thread bobbin 28 is wound to a predetermined volume 49, stop dog 35 becomes effective in a well known manner and applies against the thread volume so that winder 18 is gradually pushed away from drive wheel 6, against the action of catch spring 29, whereby the friction between winder wheel 25 and friction ring 36 is reduced until winder wheel 25 is no longer driven and the winding operation is stopped.

To remove the fully wound bobbin, winder 18 is pivoted away from stop dog 35. Consequently, catch spring 29 changes its direction of action and retains winder 18 in its rest position again. Under the action of helical spring 42, release stirrup 22 follows the motion of extension 21 of winder arm 20 thereby releasing clutch ring 10 so that, under the action of flat spring 14, engaging cam 13 of clutch ring 10 is moved back and re-engaged with one of the engaging grooves 16 of drive wheel 6. Thus, the coupling between drive wheel 6 and arm shaft 4 becomes effective again and the sewing mechanism of the machine continues to be driven by drive wheel 6 as soon as the mentioned power source is switched on.

While a specific embodiment of the invention has been shown and described in detail to illustrate the application of the principles of the invention, it will be understood that the invention may be embodied otherwise without departing from such principles.

What is claimed is:

1. A clutching device, for a sewing machine having an arm, a drive wheel, a sewing mechanism including an arm shaft, and a thread winder, said clutching device comprising, in combination, a clutch member interposed between said arm shaft and said drive wheel to couple said drive wheel to said arm shaft; pivot means mounting said clutch member, intermediate its ends, on said arm shaft for pivoting about an axis extending diametrically through said arm shaft; said drive wheel being formed with a series of circumferentially adjacent recesses on its inner surface facing said clutch member, and said clutch member having at least one tooth projecting from one end thereof toward said drive wheel for engagement in one of said recesses; spring means biasing the opposite end of said clutch member away from said drive wheel to engage said at least one tooth in one of said recesses to normally couple said drive wheel to said arm shaft; said thread winder including a drive member and being swingable about a vertical axis to engage said drive member with said drive wheel; means operable by said thread winder, responsive to said swinging movement thereof to engage said drive member with said drive wheel, to engage said clutch member at a point closely adjacent its pivot axis but spaced therefrom toward said opposite end to pivot said clutch member, against the bias of said spring means, to disengage said at least one tooth from the then-engaged drive wheel recess to uncouple said arm shaft from said drive wheel; and further means operable, responsive to accumulation of a predetermined amount of thread on said thread winder, to swing said thread winder in a direction to disengage said drive member from said drive wheel; said means operable by said thread winder, responsive to such disengagement of said drive member from said drive wheel, disengaging said clutch member for biasing of said clutch member, by said spring means, to engage said at least one tooth in one of said recesses to re-couple said drive wheel to said arm shaft.

2. A clutching device, as claimed in claim 1, in which said clutch member includes an annular portion surrounding said arm shaft.

3. A clutching device, as claimed in claim 1, in which said means operable by said thread winder comprises a release member engaged and operated by said thread winder upon movement of said thread winder to engage said drive member with said drive wheel; and means biasing said release member to disengage said clutch member for operation of said clutch member to re-couple said arm shaft to said drive wheel.

4. A clutching device, as claimed in claim 3, including pivot means pivotally mounting said release member in said arm; said biasing means comprising a tension spring connected to said arm and to said release member.

* * * * *